US011426844B2

(12) United States Patent
Koppenhoefer

(10) Patent No.: US 11,426,844 B2
(45) Date of Patent: Aug. 30, 2022

(54) APPARATUS FOR TIGHTENING THREADED FASTENERS

(71) Applicant: HYTORC Division UNEX Corporation, Mahwah, NJ (US)

(72) Inventor: Peter Koppenhoefer, Portland, PA (US)

(73) Assignee: HYTORC Division UNEX Corporation, Mahwah, NJ (US)

( * ) Notice: Subject to any disclaimer, the term of this patent is extended or adjusted under 35 U.S.C. 154(b) by 1122 days.

(21) Appl. No.: 15/577,875

(22) PCT Filed: May 31, 2016

(86) PCT No.: PCT/US2016/035062

§ 371 (c)(1),
(2) Date: Nov. 29, 2017

(87) PCT Pub. No.: WO2016/196491

PCT Pub. Date: Dec. 8, 2016

(65) Prior Publication Data

US 2018/0133869 A1 May 17, 2018

Related U.S. Application Data

(60) Provisional application No. 62/168,008, filed on May 29, 2015.

(51) Int. Cl.
*B25B 21/00* (2006.01)

(52) U.S. Cl.
CPC ..... *B25B 21/005* (2013.01)

(58) Field of Classification Search
CPC ..... B25B 21/00; B25B 21/005; B25B 21/004; B25B 23/0078; B25B 13/463;
(Continued)

(56) References Cited

U.S. PATENT DOCUMENTS 4,794,826 A * 1/1989 Franks ..... B25B 21/005 81/57.39
5,450,773 A * 9/1995 Darrah ..... B25B 13/463 81/57.39

(Continued)

FOREIGN PATENT DOCUMENTS

JP H08504680 * 5/1996

*Primary Examiner* — Robert J Scruggs
(74) *Attorney, Agent, or Firm* — Justin B. Bender, Esq.

(57) ABSTRACT

A low clearance hydraulic torque tool for tightening or loosening fasteners has an apparatus to transfer torque formed within a link drive means between a first and a second side plate. The apparatus includes: a drive plate having piston engagement means at a first end and a machined face gear with radial serrations at a second end; a ratchet drive having a machined face gear with corresponding radial serrations at a first end and a threaded fastener engagement means at a second end; and a wave spring formed between the drive plate and one of the side plates of the torque tool. The side plates of the link drive means are tapered from a first end, adjacent piston engagement means, to a second end, adjacent the threaded fastener engagement means, such that the width of the link drive means at the second end is substantially thinner than the width of the link drive means at the first end.

4 Claims, 5 Drawing Sheets

(58) Field of Classification Search
CPC ..... B25B 21/002; B25B 21/001; B25B 23/00; B25B 13/46; B25B 13/48; B25B 13/50
See application file for complete search history.

(56) References Cited

U.S. PATENT DOCUMENTS

| | | | | |
|---|---|---|---|---|
| 5,531,549 | A * | 7/1996 | Fossella | B23B 31/123 279/140 |
| 7,146,880 | B1 * | 12/2006 | Francis | B25B 21/005 81/57.39 |
| 2006/0090606 | A1 * | 5/2006 | Spirer | B25B 21/005 81/57.39 |
| 2006/0254393 | A1 * | 11/2006 | Nagata | B25B 13/465 81/63 |

* cited by examiner

FIG. 1A
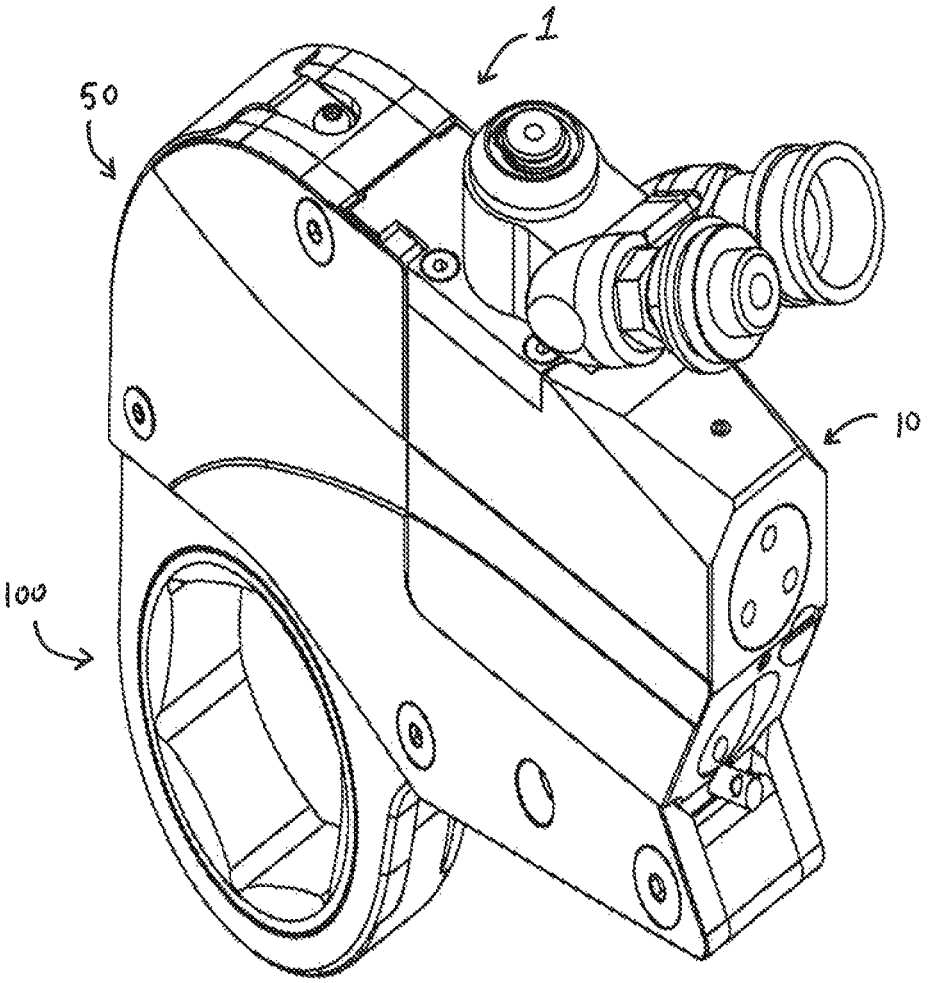
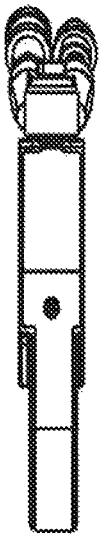
FIG. 1B
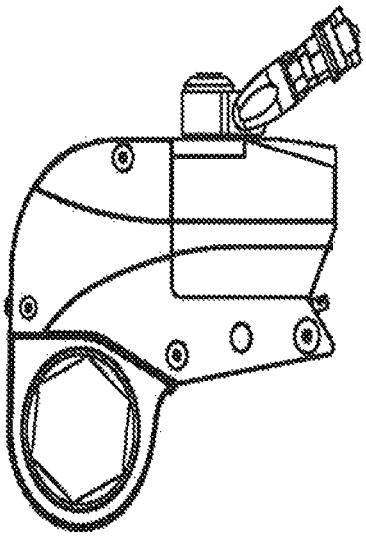
FIG. 1C
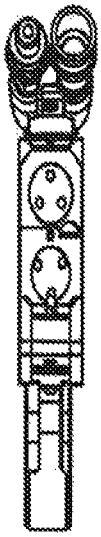
FIG. 1D

APPARATUS FOR TIGHTENING THREADED FASTENERS

CROSS REFERENCE TO RELATED APPLICATIONS

This Application is a continuation-in-part application of the following co-owned U.S. Patent Application, an entire copy of which is incorporated herein by reference: Ser. No. 62/168,008, having Filing Date of 29 May 2015, entitled "Apparatus for Tightening Threaded Fasteners".

Innovations disclosed in this Application advance technology disclosed in the following U.S. patent application, an entire copy of which is incorporated herein by reference: U.S. patent application Ser. No. 13/023,375 having Filing Date of 8 Feb. 2011 entitled "Hydraulic Torque Wrench for Tight Clearance".

BACKGROUND

Often industrial bolting applications include threaded fasteners with limited clearance and/or accessibility issues. To tighten and loosen such fasteners, operators may use a hydraulic torque wrench of the prior art including an actuator and a ratchet linkage. These two components may be modular so they can be coupled and decoupled depending on their desired use. Such actuators may include one or more hydraulic cylinders and pistons. With the actuator installed on the linkage, a free end of the actuator's piston pivotally connects to a drive lever inside the linkage. As the piston moves reciprocally, it pushes this drive lever back and forth. In turn, a ratchet mechanism formed between the drive lever and a socket causes the socket to rotate and apply torque to the threaded fastener disposed in the socket.

Although the operation of such torque wrenches is effective, existing torque wrenches in the art have similar designs for the ratchet linkage. Such linkages have side plates that sandwich internal components of the linkage, and spacers can be used between the plates. The socket installs in between these plates and remains exposed through openings in the plates. This socket is formed between the threaded fastener to be turned and the internal drive lever and ratchet mechanism, which is held between the side plates so it can be turned. Other internal and external components may be found on or in such limited clearance tools.

Although common in the industry, this form of construction for limited clearance hydraulic torque wrenches of the prior art has limitations. Such torque wrench construction increases the overall width of the wrench and/or depth of the socket, which may limit the usefulness of the wrench in some situations. In some circumstances, an obstruction or feature may lie in close proximity to the object to be closed, such as a flange. This can lead to a reduced height and/or depth clearance between the object, nut, and exposed end of the bolt or bolt head that can limit access of a conventional limited clearance hydraulic torque wrench.

Accordingly, what is needed in a hydraulic torque wrench capable of use in tight clearances to improve access of the wrench to nuts and increase the wrench's usefulness in the field.

DESCRIPTION OF INVENTION

A low clearance hydraulic torque tool for tightening or loosening fasteners has an apparatus to transfer torque formed within a link drive means between a first and a second side plate. The apparatus includes: a drive plate having piston engagement means at a first end and a machined face gear with radial serrations at a second end; a ratchet drive having a machined face gear with corresponding radial serrations at a first end and a threaded fastener engagement means at a second end; and a wave spring formed between the drive plate and one of the side plates of the torque tool. The side plates of the link drive means are tapered from a first end, adjacent piston engagement means, to a second end, adjacent the threaded fastener engagement means, such that the width of the link drive means at the second end is substantially thinner than the width of the link drive means at the first end.

Advantageously the low clearance face tooth ratchet assembly minimizes volume and mass of the tool. Only one drive plate is necessary which is tapered from a first end to a second end. Further, side plates of the link drive means are tapered from a first end to a second end. Such geometry minimizes the width of portions of the link drive means making the second end, adjacent the threaded fastener engagement means, substantially thinner than the first end, adjacent the piston engagement means. Higher torque values are transferred in a smaller enclosure via only two parts. Notably no drive and/or reaction pawl is necessary as the teeth of the drive plate and the ratchet drive achieve full facial engagement. The design of the connection coupling is backlash-free, maximizes tool safety, minimizes risk of failures/fatigue from wear, bending, scuffing and cracking, and is suitable for changing forces.

Further features of the invention are set out in claims 2 to 4 appended hereto.

The invention may be described by way of example only with reference to the accompanying drawings, of which:

FIGS. 1A-1D show perspective, front, side and back views of a hydraulic torque wrench having a low clearance face tooth ratchet assembly according to the present invention;

FIGS. 1A-1D show perspective, front, side and back views of a low clearance face tooth ratchet assembly 100 for a hydraulic torque tool 1 having a cylinder-piston means 10 and a link drive means 50.

Figures 2A, 2B, 2C:
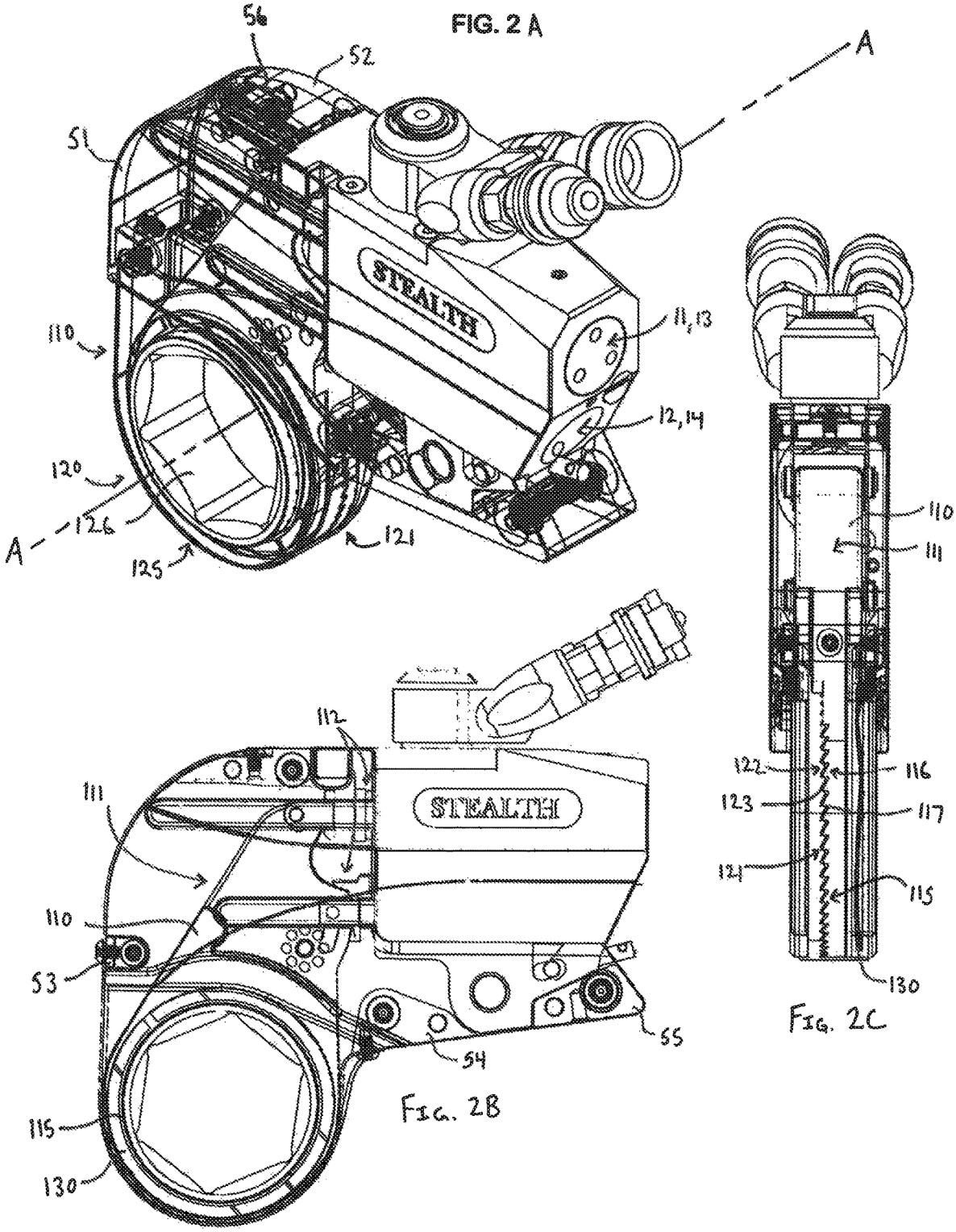
FIGS. 2A-2C show perspective, side and front views of internal components of the link drive means of the hydraulic torque wrench having the low clearance face tooth ratchet assembly according to the present invention.
Figure 3A:
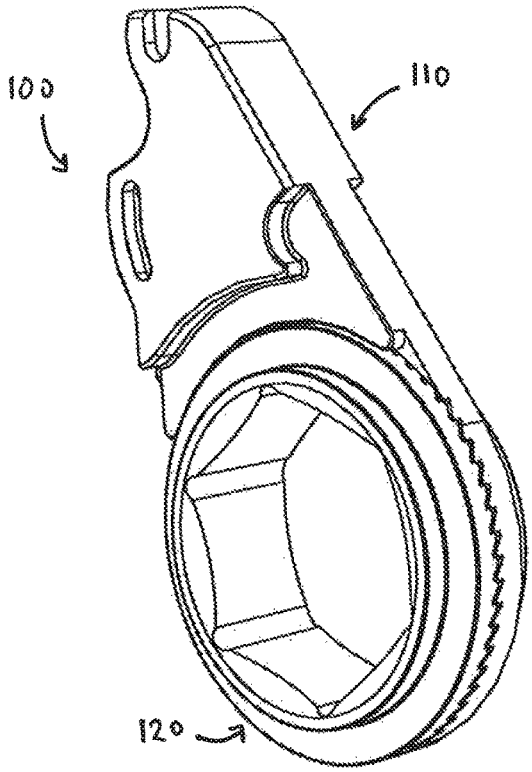
FIGS. 3A-3B show perspective views of the low clearance face tooth ratchet assembly according to the present invention.
Figure 3B:
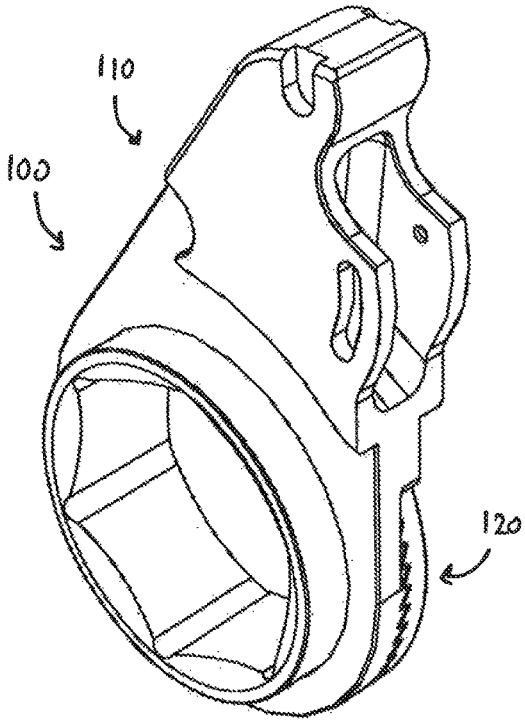
Figure 4A:
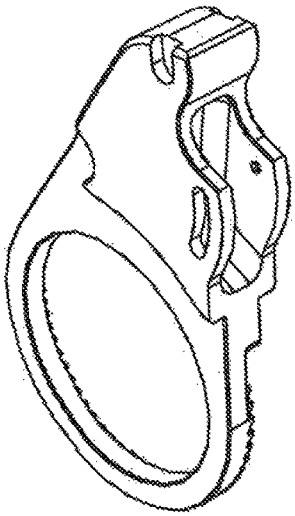
FIGS. 4A-4D show perspective views of a drive plate and a ratchet drive of the low clearance face tooth ratchet assembly according to the present invention.
Figure 4B:
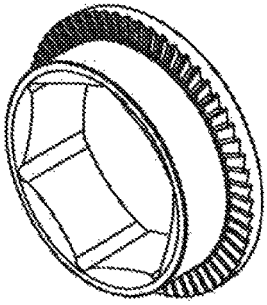
Figure 4C:
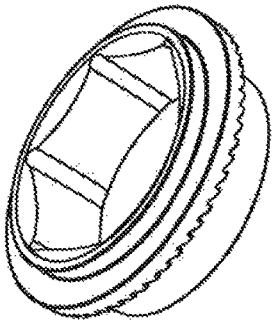
Figure 4D:
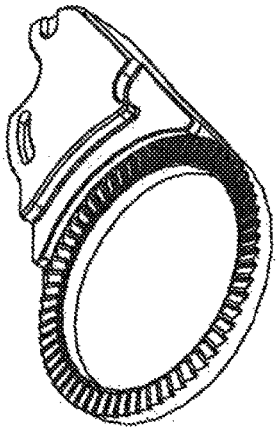
Figure 5A:
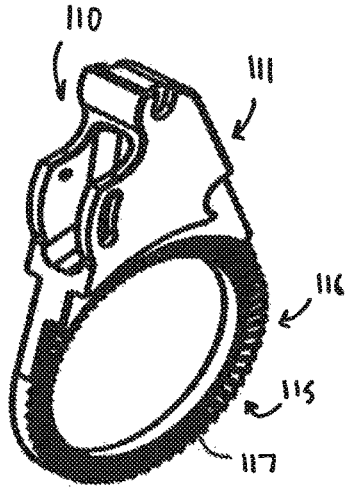
FIGS. 5A-5F show perspective, front, detailed, side and back views of the drive plate of the low clearance face tooth ratchet assembly according to the present invention.
Figure 5B:
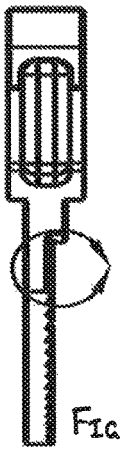
Figure 5C:
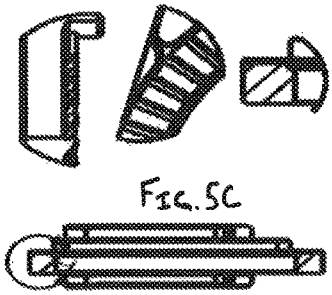
Figure 5D:
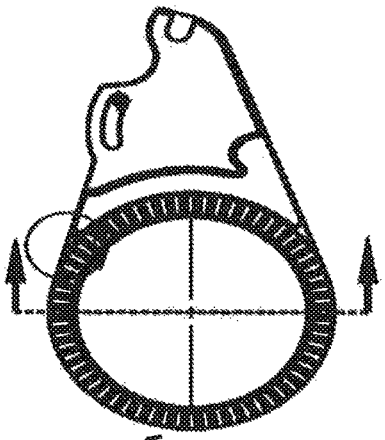
Figure 5E:
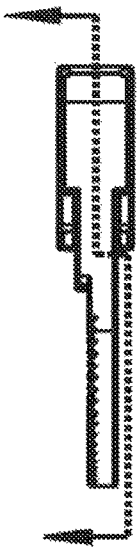
Figure 5F:
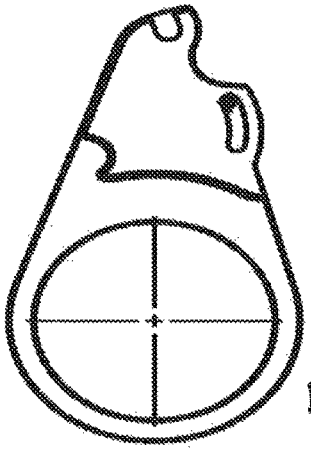
Figure 6A:
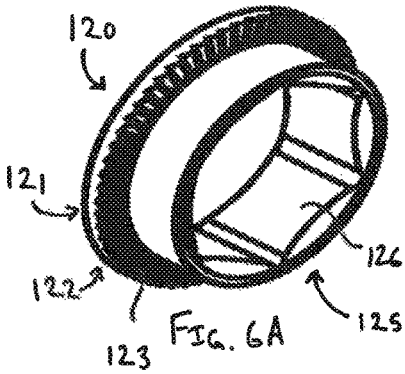
FIGS. 6A-6D show perspective, front, side and cross-sectional views of the ratchet drive of the low clearance face tooth ratchet assembly according to the present invention.
Figure 6B:
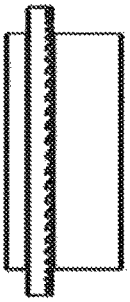
Figure 6C:
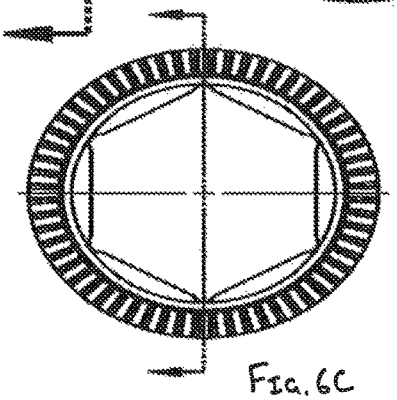
Figure 6D:
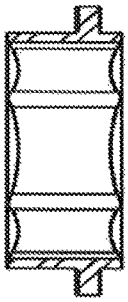
Figures 7A, 7B, 7C, 7D:
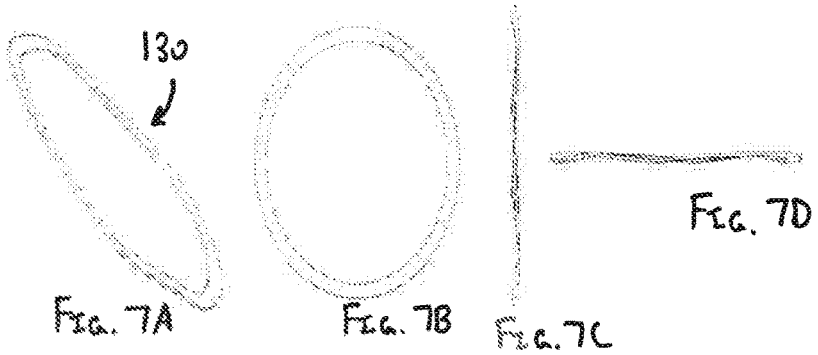
FIGS. 7A-7D show perspective, front and side views of a wave spring of the hydraulic torque wrench having the low clearance face tooth ratchet assembly according to the present invention.
Figures 8A, 8B, 8C, 8D:
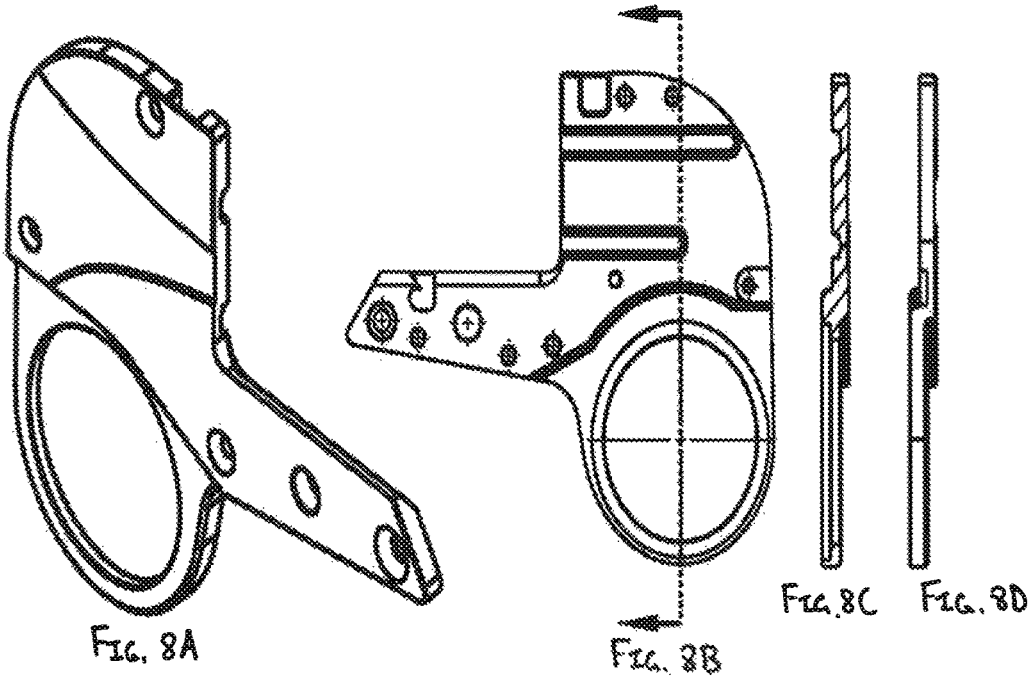
FIGS. 8A-8D show perspective, back, cross-sectional and side views of a side plate of the hydraulic torque wrench having the low clearance face tooth ratchet assembly according to the present invention.
Figure 9:
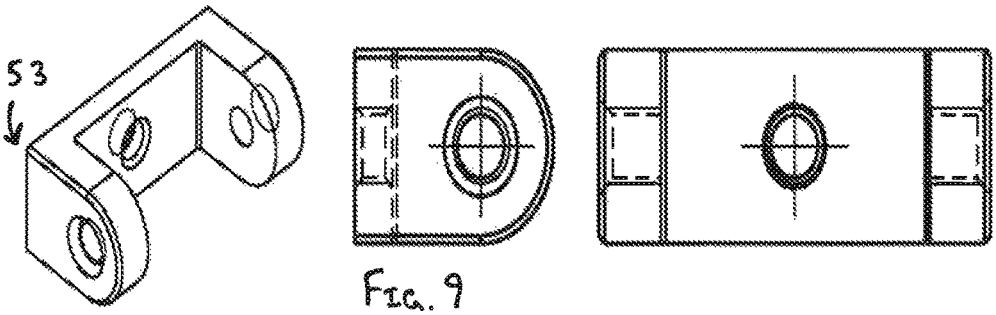
FIGS. 9-10 show various views of examples of spacers of the hydraulic torque wrench having the low clearance face tooth ratchet assembly according to the present invention.
Figure 10:
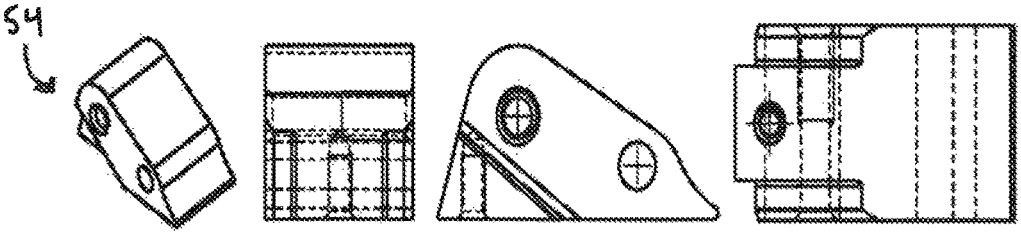

FIGS. 2A-2C show perspective, side and front views of internal components of link drive means 50 of hydraulic torque tool 1 having low clearance face tooth ratchet assembly 100. Face tooth ratchet assembly 100 which includes a drive plate 110 having piston engagement means 112 at a first end 111 and a machined face gear 116 with radial serrations 117 at a second end 115. Face tooth ratchet assembly 100 also includes a ratchet drive 120 having a machined face gear 122 with corresponding radial serrations 123 at a first end 121 and a threaded fastener engagement means 126 at a second end 125. Face tooth ratchet assembly 100 is formed between and moves within a first and a second side plate 51 and 52 of link drive means 50 held rigidly apart by a first, a second a third and a fourth spacer 53, 54, 55 and 56.

FIGS. 2A-2C indicate that drive plate 110 is reciprocatingly driven by a first and a second hydraulic piston 11 and 12 in a first and a second cylinder 13 and 14 (not shown in detail) in advance and retract strokes. Drive plate 110 oscillates axially about a turning force axis A. During the advance stroke the corresponding teeth 117 and 123 of drive plate 110 and ratchet drive 120 engage under load from a wave spring 130 to tighten or loosen the threaded fastener. Wave spring 130 offers similar force and deflection as ordinary coil/compression springs yet fits in the tight radial and axial space of tool 1. Wave spring 130 is formed between drive plate 110 and side plate 52. During the retract stroke corresponding teeth 117 and 123 of drive plate 110 and ratchet drive 120 disengage and glide past each other.

During the advance stroke corresponding teeth 117 and 123 of drive plate 110 and ratchet drive 120 nonrotatably engage relative to each other. Transmitted torque is proportional to the circumferential force, which is maximized compared with ratchet assemblies of the prior art. The angular surfaces of the teeth transmit a large portion of the circumferential force with positive locking. Tensioning media, such as, for example, disk (wave) springs, apply the required axial force to lock the teeth into torque transfer engagement. The teeth mesh around a ring and the torque capacity of the teeth increases with their diameter, arranged to accommodate the threaded fastener. Generally tapered, asymmetrical teeth are used with variable profile angles. The coupling is defined by the groove count, the outer diameter of the cylindrical feature, the bottom angle of the grooves (to the axis of the cylindrical feature) and their depth.

FIGS. 3-10 show various views and more detail of components of low clearance face tooth ratchet assembly 100 and/or torque tool 1.

Advantageously low clearance face tooth ratchet assembly 100 minimizes volume and mass of torque tool 1. Only one drive plate 110, rather than two typical of the prior art, is necessary which is tapered from a first end to a second end. Further, side plates 51 and 52 of link drive means 50 are tapered from a first end to a second end. Such geometry minimizes the width of portions of link drive means 50 making second end 115, adjacent threaded fastener engagement means 126, substantially thinner than first end 111, adjacent piston engagement means 112. Higher torque values are transferred in a smaller enclosure via only two parts. Notably no drive and/or reaction pawl is necessary as teeth (serrations) 117 and 123 of drive plate 110 and ratchet drive 120 achieve full facial engagement. The design of the connection coupling is backlash-free, maximizes tool safety, minimizes risk of failures/fatigue from wear, bending, scuffing and cracking, and is suitable for changing forces.

The figures show face tooth ratchet link assembly 100 for use in low clearance hydraulic tools but may be adapted for use in square drive tools and links for use with both such tools powered either electrically, hydraulically, manually or pneumatically.

It will be understood that each of the elements described above, or two or more together, may also find a useful application in other types of constructions differing from the types described above. The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the invention in diverse forms thereof.

While the invention has been illustrated and described as embodied in a fluid operated tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

When used in this specification and claims, the terms "comprising", "including", "having" and variations thereof mean that the specified features, steps or integers are included. The terms are not to be interpreted to exclude the presence of other features, steps or components.

What is claimed is:

1. A low clearance hydraulic torque tool for tightening or loosening fasteners having an apparatus to transfer torque within the torque tool formed within a link drive means and between a first and a second side plate of the link drive means, the apparatus including:

a drive plate having piston engagement means at a first end and a machined face gear with radial serrations at a second end;

a ratchet drive having a machined face gear with corresponding radial serrations at a first end and a threaded fastener engagement means at a second end;

a wave spring formed between the drive plate and one of the side plates of the torque tool; and wherein the side plates of the link drive means are tapered from a first end, adjacent piston engagement means, to a second end, adjacent the threaded fastener engagement means, such that the width of the link drive means at the second end is substantially thinner than the width of the link drive means at the first end.

2. A low clearances apparatus hydraulic torque tool according to claim 1 wherein during an advance stroke of the torque tool the corresponding radial serrations of the drive plate and the ratchet drive engage under load from the wave spring to tighten or loosen the threaded fastener.

3. A low clearance hydraulic torque tool according to claim 1 wherein during a retract stroke of the torque tool the corresponding radial serrations of the drive plate and the ratchet drive disengage and glide past each other.

4. A low clearance hydraulic torque tool according to claim 1 wherein the drive plate is tapered from the first end to the second end.

* * * * *